United States Patent [19]

Berger

[11] 4,214,947

[45] Jul. 29, 1980

[54] PROCESS FOR THE CONTINUOUS IMPREGNATION OF A CELLULOSIC MATERIAL

[75] Inventor: Pierre Berger, Saint-Etienne, France

[73] Assignee: Creusot-Loire, Paris, France

[21] Appl. No.: 9,839

[22] Filed: Feb. 6, 1979

[30] Foreign Application Priority Data

Feb. 27, 1978 [FR] France ..... 78 05495

[51] Int. Cl.[2] ..... D21C 1/00

[52] U.S. Cl. ..... 162/18; 162/19; 162/56; 162/237; 162/242; 162/DIG. 2; 100/75; 100/146

[58] Field of Search ..... 162/237, 233, 234, 235, 162/236, 242, 23, 24, 26, 27, 18, 19, 56; 241/28, 42, 260.1; 425/208; 100/74, 75, 146

[56] References Cited

U.S. PATENT DOCUMENTS

| | | | |
|---|---|---|---|
| 1,419,847 | 11/1919 | Hamilton | 241/251 |
| 2,943,012 | 6/1960 | Dunning et al. | 162/18 |
| 3,085,623 | 4/1963 | Ginaven et al. | 162/236 |
| 4,088,528 | 5/1978 | Berger et al. | 162/236 |

FOREIGN PATENT DOCUMENTS

| | | | |
|---|---|---|---|
| 808854 | 2/1959 | United Kingdom | 162/18 |

*Primary Examiner*—S. Leon Bashore
*Assistant Examiner*—Steve Alvo
*Attorney, Agent, or Firm*—Haseltine, Lake & Waters

[57] ABSTRACT

The continuous treatment of a cellulosic material in the form of chips to produce at least partial delignification of the material without true mechanical grinding is effected in apparatus comprising two parallel meshing screws which are rotated in the same direction in a sheath and have identical threads providing a plurality of zones of different pitch. The material is passed in succession through a first zone for feeding the material downstream, a first braking zone for causing a first compression of the material, a second zone for feeding the material downstream and in which the material is brought into contact with a reagent, e.g. steam or a chemical reagent, and a second braking zone for causing a second compression of the material. In each compression stage the material is subject to alternate increases and decreases in pressure, the first compression stage causing the expulsion of any water present in the material and the second compression stage causing the expulsion of any spent reagent and residual liquors in the material.

4 Claims, 8 Drawing Figures

PROCESS FOR THE CONTINUOUS IMPREGNATION OF A CELLULOSIC MATERIAL

FIELD OF THE INVENTION

The invention relates to a process and an apparatus for the continuous treatment of a cellulosic material, such as wood, in small pieces, such as chips, and more especially relates to the pre-treatment of the chips for the manufacture of paper pulp. However, the invention can also be used for the preparation of any product based on fibrous material.

PRIOR ART

In U.S. Pat. No. 4,088,528 there is described a machine for the preparation of paper pulp, comprising two parallel screws of identical thread, which are caused to rotate in the same direction inside a sheath which envelops them, and the threads of which have successive zones of different pitch making it possible to carry out the continuous mechanical grinding of chips introduced at the upstream end of the screws, to obtain, downstream, a paper pulp which can be used, after refining, in machines for the manufacture of paper.

It is known that natural ligneous materials, in particular wood, which are used for the manufacture of paper are composed of cellulosic fibres which are bonded to one another by means of lamellae essentially composed of lignin and of hemicellulose, and that the first stage in the manufacture of paper consists in dissociating these elements so as to bring out the fibres in the individual state. The pulp thus produced is generally in a very dilute form and it can be used directly for the manufacture of paper in so-called integrated factories, or it can first be dried in order to facilitate its transportation. In this case, before being used, the pulp is broken up in water, in order to bring it back to the liquid state, and then passes into the paper machine. However, in all cases, the dilute pulp first passes through refiners, the purpose of which is to bring out the constituents of the fibres, called "fibrils", the latter making it possible to form a sheet by virtue of their close proximity to one another.

The fibres can be isolated by means of a mechanical grinding treatment which uses the combined effects of compression stresses and shear stresses, and/or by means of a chemical delignification treatment which makes it possible, by impregnating the chips with a reagent, to dissolve to a greater or lesser extent the lignin and the other products binding the fibres to one another.

In general, a distinction is made between the mechanical chip pulps in which the grinding is achieved by mechanical means, and chemical pulps in which the lignin is dissolved by chemical reagents and the mechanical treatment is carried out on fibres which have already been dissociated, there being a whole series of intermediate processes combining the softening action of a reagent with a mechanical action, it being possible for this softening to be achieved by means of steam, a chemical product or even a combination of this product and steam. Depending on the individual case, reference will be made to thermomechanical pulp, mechanical-chemical pulp, chemical-thermomechanical pulp or semi-chemical pulp.

The abovementioned U.S. Pat. No. 4,088,528 describes a process and a machine for the manufacture of paper pulp, in which essentially a mechanical grinding was carried out by means of the combined effect of compression stresses and shear stresses obtained by passing the chips through the screws. The object of the machine was the production of a paper pulp from wood chips, that is to say the production of well-isolated and fairly small fibres, so as to enable the paper to be manufactured directly after a refining operation. Now, although the pulp obtained by mechanical grinding have certain qualities, it is preferred, for some uses, to employ chemical pulp for which the mechanical work is reduced to a minimum. In fact, it is difficult to prevent the separation of the fibres by mechanical means from causing a reduction in the length of these fibres.

The preparation of chemical pulp is generally carried out in large vessels, referred to as "digesters", at high temperature and under a high pressure. The intimate penetration of an active liquid inside the chips is thus achieved. At the end of this operation, which is referred to as cooking and takes several hours, the various bonding agents, such as the lignin, have become dissolved in a residual liquid and the cellulosic fibres are virtually separate from one another so that fairly minimal mechanical operation makes it possible to obtain a usable pulp. The advantage of this process is that it preserves the integrity of the fibres, but the treatment is extremely long and requires very bulky and expensive installations which can only be viable for large-scale high-performance production.

Furthermore, even if it is not desired to achieve the virtually complete isolation of the fibres by a purely chemical method, it is frequently necessary, before carrying out mechanical grinding of the chips, to subject the latter to a pre-treatment which makes it possible to soften the lignin by impregnating the chips with a reagent such as steams and/or various chemical reagents. This pre-treatment must also be carried out, if possible, without damaging the fibres, and the time required for the complete impregnation of the chips is rather long.

SUMMARY OF THE INVENTION

An object of the invention is to provide a process and a machine making it possible to carry out continuous and relatively very rapid impregnation of wood chips with reagent, from the pre-treatment before passage through a mechanical grinding machine up to the complete chemical treatment with which the pulp obtained at the outlet of the machine has analogous characteristics to the usual chemical pulps.

In the process according to the invention, the machine used may be of the same type as that described in U.S. Pat. No. 4,088,528, that is to say a machine comprising two parallel meshing screws which are caused to rotate in the same direction inside a sheath, and the threads of which possess successive zones of different pitch.

In fact, whereas the essential purpose of the machine of French U.S. Pat. No. 4,088,528 was to carry out mechanical grinding of the chips, which made it possible to obtain divided fibres at the outlet, it has been noticed that, despite intense mechanical work, it is possible, by judiciously selecting the dimensional characteristics and the mode of operation of the machine, to eliminate virtually completely the effect of shear on the chips which enables the fibres to be isolated, and to achieve a rapid impregnation which makes it possible to obtain, at the outlet, a pre-treated pulp consisting of chips which are well-softened but in which the fibres have not been divided.

In accordance with one aspect of the invention there is provided a process for the continuous treatment of a cellulosic material in the form of chips, comprising passing said material continuously through apparatus comprising two parallel meshing screws having identical threads and which are rotated in the same direction inside a sheath which envelops them, said threads of said screws possessing successive zones of different pitch, wherein said material is passed continuously and in succession through a first zone of said screws for feeding and carrying said material downstream, a first braking zone which causes a first compression of said material, at least one subsequent zone for carrying said material downstream, in which, if appropriate, said material is brought into contact with a reagent introduced into said sheath, and a second braking zone which causes a second compression of said material, during each said compression, said material passing through a series of alternate stages of increases in pressure, the relative magnitude of which increases gradually, and of drops in pressure, the relative magnitude of which decreases gradually, and the passage of said material through each braking zone causing a simple separation of said chips, which can assist the squeezing of the chips into said threads without decreasing the length of the fibres, said first compression causing the expulsion, in the upstream direction, of water present in said material, and each subsequent compression causing the expulsion of any spent reagent and of residual liquors present in said material, the overall treatment causing at least a partial delignification of said material without true mechanical grinding.

According to another aspect of the invention there is provided apparatus for the continuous treatment of a fibrous material in the form of chips, comprising two parallel screws of identical meshing threads, means for rotating said screws in the same direction inside a sheath enveloping said screws, said threads of said screws consisting of successive zones of different pitch providing, downstream from an orifice for the introduction of material into said sheath, a feed zone of forward pitch for carrying the material downstream, a first braking zone of reverse pitch for forming a continuous plug by squeezing the material, and at least one expansion zone of forward pitch for carrying the material downstream, and into which zone a reagent may be introduced, a second braking and squeezing zone of reverse pitch, the braking zones possessing threads of reverse pitch which are provided with apertures for the passage of the material downstream, the apertures having a width which, in use of the apparatus, is small enough to cause the formation of a continuous plug of squeezed material in the threads and the gradual compression of the material upstream thereof, but which is large enough to effect at most only a simple separation of the chips, assisting the squeezing of the chips into said threads without reducing the length of the fibres, the expansion zone situated between the two braking zones being sufficiently long to carry out therein a treatment of the material by impregnation with a reagent introduced therein, the sheath being provided with an orifice for the introduction of a reagent and with an orifice for discharging residual liquid, which orifices are situated respectively upstream and downstream of said treatment zone.

BRIEF DESCRIPTION OF THE DRAWINGS

The invention will be more fully understood from the following description of an embodiment thereof, given by way of example only, with reference to the accompanying drawings.

In the drawings.

DETAILED DESCRIPTION

Figure 1:
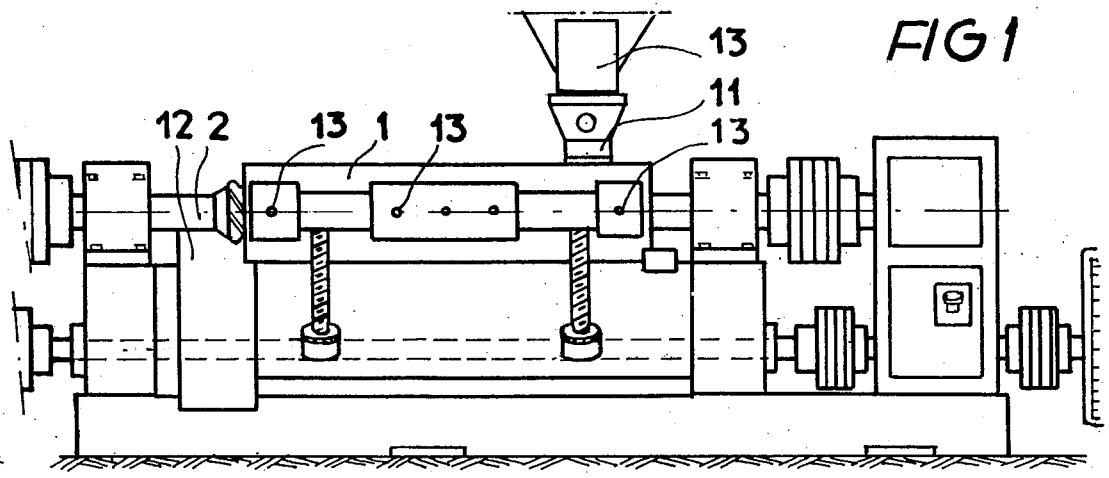
FIG. 1 is a general side view of an embodiment of apparatus according to the invention.
Figure 2:
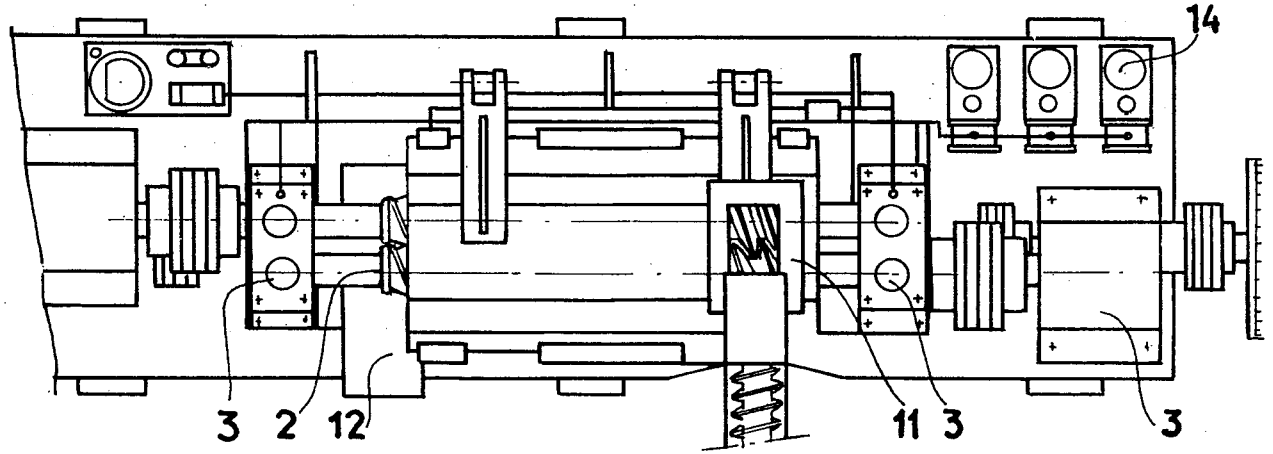
FIG. 2 is a top view of the apparatus of FIG. 1.

The apparatus shown in FIGS. 1 and 2 comprises, inside a sheath 1 mounted on a frame, two parallel meshing screws 2, each of which consists of helical threads provided on a shaft, and which are driven at the same speed and in the same direction by means of a motor or by means of two synchronized motors placed respectively at the two ends of the machine.

The sheath 1 is provided with an open orifice 11 situated in its upper part at one of its ends, and is open at its other end so that the material which is introduced upstream through the orifice 11 and carried along by rotation of the screws can leave freely at the downstream end and is discharged through a channel 12. The material to be treated, which is normally wood chips, is introduced through a hopper 11*a* provided in its lower part with a discharge screw which emerges above the orifice 11.

Figure 1A:
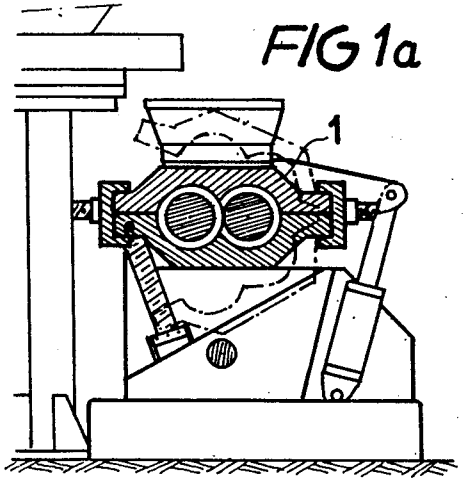
FIG. 1*a* is a view in section taken along line I—I in FIG. 1.

As shown schematically in section in FIG. 1*a*, the sheath 1 advantageously consists of two parts, on either side of the plane passing through the axes of the screws, and this makes it possible, if necessary, to open the sheath in the event of a breakdown or for examining the process for treating the material in the screws.

The sheath 1 is provided with a plurality of orifices 13 which are distributed over its length and connected to metering pumps 14 for introducing certain reagents at selected points on the machine.

Figure 3:
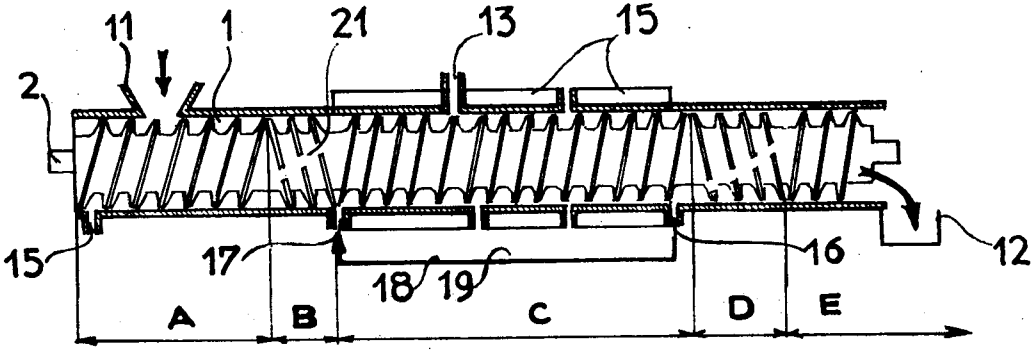
FIG. 3 is a schematic view, in longitudinal section, of part of the apparatus of FIG. 1.

The principle of the process is illustrated schematically by FIG. 3.

The two screws 2 are provided with identical threads which mesh in one another and define a succession of zones of different pitch. The material introduced through the orifice 11, at the upstream end of the apparatus, first encounters a zone A in which the screws have threads of forward pitch, carrying the material downstream, then a zone B of reverse pitch, a zone C for carrying the material downstream, a zone D of reverse pitch and, finally, a zone E for discharging the material.

The purpose of the zones B and D of reverse pitch is to ensure braking of the material in order to build up that which is referred to as a continuous plug, formed by the squeezed and compressed material filling the threads.

In fact, the material carried downstream through zone A tends, on arriving in zone B, to return upstream because the threads are reversed. The relative lengths of the zones and the pitches of the threads are chosen so that the tendency to be carried downstream is predominant; however, this results in high compression of the material at the end of zone A. To facilitate and control the passage of the material downstream, the threads in zone B are provided with apertures 24 which are similar to those shown in FIG. 7 and consist of openings created in the threads 23 and which extend from the shaft of the screw to the periphery of the thread. By virtue of the rise in pressure, these apertures make it possible for part of the material to pass from one thread into the following thread. Moreover, these apertures 24 are uniformly distributed around the shaft 2 and, since the movements of the screws are synchronized, the latter can be set so that the apertures of the two screws coincide, in pairs, in the zone of interference of the threads during the rotation of the screws. At this moment, passage of the material from one groove to the other can take place, despite the effect by which the material is carried upstream due to the reverse pitch. It is therefore understood that, by selecting the relative width of the apertures, it is possible to regulate the conditions under which the material passes downstream and, consequently, the upstream compression effect.

In the installation described in U.S. Pat. No. 4,088,528, the object was to grind the chips. This effect was achieved mainly by selecting the width of the apertures so that they were small enough to allow only adequately ground material to pass downstream. Thus, the inadequately ground chips were forced to remain upstream of the zones of reverse pitch, where they were subjected to high compression and intense malaxation making it possible, by virtue of the shear forces created by the rubbing of the chips against one another, gradually to effect adequate grinding.

In contrast, the present apparatus is designed not to grind the chips but only to impregnate them with a reagent in accordance with a process which will be described below. Thus, the width of the apertures will be selected not as a function of the degree of grinding which it is desired to achieve, but only in order to regulate the passage of the material downstream, so as to obtain the desired compression, downstream from the preceding zone, and so as to carry out a simple separation of the chips, making it possible to assist the squeezing of the chips into the grooves and, consequently, the formation of a continuous plug. Thus, zone C, which, as will be seen, constitutes the treatment zone, is enclosed by two plugs B and D and can therefore be placed under a pressure which is much greater than the atmospheric pressure prevailing at the inlet of the feed zone A and at the outlet of the discharge zone E.

Figure 4:
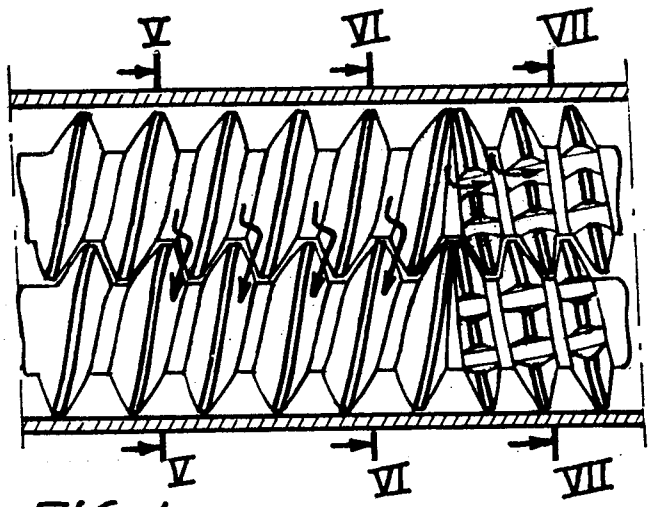
FIG. 4 is a partial top view of part of the screws of the apparatus of FIG. 1.

FIG. 4 shows, on an enlarged scale, the downstream part of a zone, such as zone A or zone C, for carrying the material along, which precedes a zone of reverse pitch, such as zone B or zone D. FIG. 4 will be described as illustrating zones C and D but the description is equally applicable to zones A and B.

Figure 5:
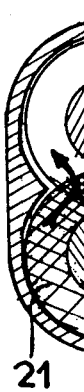
FIGS. 5, 6 and 7 are sectional views showing different stages of the treatment process respectively taken along lines V—V, VI—VI and VIII—VIII in FIG. 4.

FIG. 5 is a transverse section taken along line V—V in FIG. 4 which is relatively far from the zone of reverse pitch D. In this part of the screw, the chips do not totally fill the grooves. In fact, they are carried downstream in a translational movement by a pumping action of the screws, which is exerted even when the threads are not full.

However, part of the material tends to be carried around the shaft by the rotation of the thread, and it can be considered that, in a part which is remote from the zone of reverse pitch, such as that shown in FIG. 5, the ratio of the material which slides relative to the screws to that which rotates with the screws is 0.7, which means that 70% of the movement of the material is a translational movement parallel to the screws and 30% is a rotational movement around the shaft.

As a result, a certain part of the material, carried around the shaft towards the area 20 of interference of the screws, tends to accumulate upstream from this area of interference. In fact, as seen in FIG. 5, the material carried along by the rotation of, for example, the screw **2*a* tends to pass onto the other screw 2*b* but, in order to do this, it must pass through an area 20, the cross-section of which is reduced by the meshing of the screws. This results in an accumulation of material and, consequently, a rise in pressure, upstream from the area of interference 20 on the screw 2*a* and, in this case, at the lower part of the screw, taking into account the direction of rotation shown. On the other hand, the material passing onto the other screw 2*b*** is mainly carried along by translation and this results in an expansion and, consequently, a drop in pressure.

In the same manner, at the upper part of the screw **2*b*, the material accumulates upstream from the area of interference 20 and this causes a rise in pressure followed, as already stated, by an expansion at the upper part of the screw 2*a***.

Consequently, in each thread, part of the material passes through an area 21, upstream from the area of interference 20, in which there is a rise in pressure, and then through an area 22, downstream from the area of interference 20, in which there is a drop in pressure.

Figure 6:
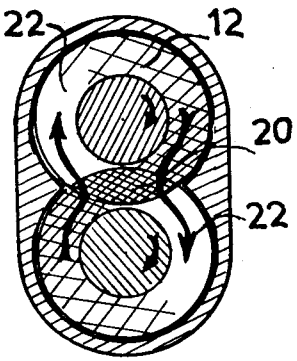

When approaching the zone of reverse pitch D, as shown in FIG. 6, because of the braking brought about by the reverse pitch, the pressure gradually increases and the longitudinal translation speed of the material decreases. As a result, a larger amount of material is carried around the shafts by the rotation of the threads and, consequently, a larger amount of material accumulates upstream from the area of interference 20. Consequently, when approaching zone D of reverse pitch, the accumulation of material, and hence the rise in pressure, inside each thread, occur over an area 21 of increasing length, the size of the area of expansion 22 correspondingly decreasing.

It is therefore seen that, as it approaches the braking zone D, the material is not compressed continuously; on the contrary, it passes, in each thread, through a series of alternate stages of increase in pressure, the relative magnitude of which increases gradually, and of expansion, the relative magnitude of which decreases gradually.

Figure 7:
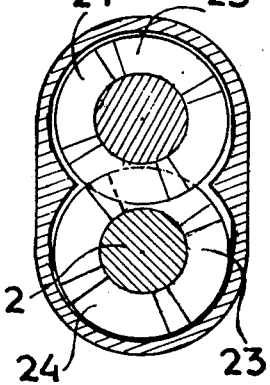

In the zone of reverse pitch shown in FIG. 7, the threads are completely full and the movement of the material is effected virtually entirely by rotation around the shafts, except for that part of the material which passes downstream by passing through the apertures 24.

It will be noted that this process is due, in particular, to the fact that the screws have identical threads and are driven in the same direction. In fact, when the screws are driven in opposite directions, there is also a tendency to cause part of the material to rotate around the shaft. However, the material carried along in this way is forced to pass between the threads and is therefore subjected to a calendering effect which is likely to damage the fibers. Such an effect does not exist in the above-described machine in which the screws are driven in the same direction, because the material does not pass between the threads but only passes from one thread to the other, remaining on the same side of the plane passing through the axes of the screws. The material is not therefore subjected to any significant calendering but only to a rise in pressure and also to a kind of turning over, on passing from one screw to the other; as will be seen, this has a favourable effect.

In fact, this alternation at close intervals of rises and drops in pressure greatly assists the impregnation of the material with a reagent, the purpose of which is to dissolve the lignin.

First of all, it must be noted that the raw material used, that is to say most frequently wood chips, contains a certain amount of water. In the most common case, the chips used for the manufacture of paper contain of the order of 55% of water. Even if unboiled chips are used, the water content is about 40%, at least in the case of green wood.

Before arriving in zone B of reverse pitch, the chips introduced through the orifice 11 are subjected to the alternation of rises and drops in pressure in the threads of the screws, which has been described. This results in expulsion of the water which they contain and, since each thread is only partially full, this water can return upstream and be discharged through an orifice 15 (FIG. 3).

The extent of this drying will depend on the pressure prevailing downstream from zone A and in zone B and, as has been seen, this pressure can be regulated in accordance with the parameters of the screws by selecting the width of the apertures 24. In practice, the procedure is such that the chips retain a moisture content which is sufficient for them to be conveyed by the screws. In fact, it is likely that a material which is too dry would be poorly carried along and would not pass through the apertures 24.

This prior expulsion of part of the water present in the material considerably assists its impregnation by the reagent and, in particular, makes it possible to increase the concentration of the reagent and, consequently, its efficiency.

The process in which the material passes through a series of alternate stages of increase and drops in pressure also assists the impregnation with the reagent.

Having passed through zone B of reverse pitch, the material arrives upstream from zone C at a rate which depends, in particular, on the width of the apertures 24, and it can distribute itself freely in the grooves without filling them.

In zone C, a chemical reagent and/or steam under pressure is introduced through an orifice 13. Since the threads are not full, this reagent can spread out in zone C, in particular upstream, and the material thus distributed as a thin layer in the threads is under the best conditions for impregnation.

Moreover, as zone D is approached, an increasingly large part of the material is subjected to a rise in pressure in the area 21 of each thread, upstream from the area of interference 20. This rise in pressure tends to drive out the reagent, with which the material had become impregnated, and also the dissolved lignin. On passing from one screw to the other screw, the material which had become compressed expands in the area 22 in contact with the reagent and can again become impregnated therewith. Thus, the material alternately absorbs the reagent in the areas of expansion 22 and rejects it, together with the lignin, in the areas 21 in which there is a rise in pressure. Furthermore, the turning over of the material, which takes place on passing from one screw to the other, also assists its contact with the reagent.

Finally the malaxation effect produced by the screws assists homogenization of the material without damaging the fibres.

In conventional grinders, this homogenization is achieved by diluting the chips with a large amount of liquid, and it is therefore impossible to use concentrated reagents without employing a very large amount thereof. In contrast, in the above described apparatus, the work of malaxation, produced in particular by passing an increasingly large proportion of the material from one thread of a screw to the other, itself ensures homogenization without dilution, and it is therefore possible to use a small amount of concentrated liquors.

Moreover, it is possible to monitor the effectiveness of the reagent during the treatment. In fact, as has been seen, the spent reagent and the dissolved lignin are expelled each time there is a rise in pressure and to an increasing extent as zone D of reverse pitch is approached. In each thread, the spent liquid is expelled towards the area of expansion 22 and can pass from one thread to the other in the space between the periphery of the screw and the sheath, provided the thread is not completely full of compressed material. Consequently, by providing discharge orifices in the wall of the sheath, downstream in or of zone C, it is possible to discharge a large proportion of the spent liquor, the remainder being discharged at the outlet of the machine, together with the treated material. These orifices 16 must simply be provided with openings which are small enough not to allow those fibres to pass through which could be in the individual state, although, as already stated, the mechanical grinding work is not desired. Of course, the cross-sections of the orifices 16 must be calibrated as a function of the operating conditions, in order to maintain the desired pressure downstream of the zone.

As already described in the grinding machine in U.S. Pat. No. 4,088,528, chambers surrounding the sheath make it possible to heat or cool the latter at the most appropriate point. For example, it is possible to heat the sheath mainly in that path which is upstream from zone C, at a point where the chips are expanded and where an increase in temperature assists the effectiveness of the reagent. On the other hand, in that part which is downstream from zone C, where the compression of the material can, by itself, cause an increase in temperature, it is possible to control the supply of heat or the withdrawal of heat by external cooling, so as to keep the temperature of the reagent at a desirable level.

A further advantage of the process, which assists good impregnation, lies in a rather unexpected fact. The screws are driven at a rather low speed, for example 150 rpm, it being possible for this speed to increase to 300 rpm. Now, at such a speed, the alternation of the stages in which there are increase in pressure and drops in pressure in the threads of the screws can correspond to the relaxation time of the wood, so that the chips have time to absorb the reagent in the expansion zones 22 before there is a further rise in pressure. This effect also assists good impregnation of the chips with the reagent.

Thus, by virtue of the effect of this alternation of increase in pressure and of expansions, this process makes it possible to impregnate the wood thoroughly, while retaining sufficient moisture for the chips to circulate in the machine without damaging the fibres, the passage into the compression zones causing a simple fragmentation but without true grinding.

As a result, depending on the characteristics of the apparatus, impregnation can be carried out therein with any kind of reagent.

This reagent can simply be steam. In this case, the treatment zone is relatively short, because it is desired to achieve only a softening of the chips for the manufacture of thermomechanical pulp. The material which has been subjected to this pre-treatment can then be directed towards a conventional grinding installation, for example disc grinders, or alternatively a grinding machine of the screw type, such as that described in U.S. Pat. No. 4,088,528.

Such a steam-heating operation can also be combined with impregnation with a reagent, such as sodium bisulphite, which is introduced at the same time as the steam through another orifice. For example, the orifice for the introduction of the steam can be situated upstream of the treatment zone and the bisulphite can be introduced downstream in a zone in which the accumulation of material in the two screws upstream from the zone of interference produces a partial seal between the threads.

At this point, it may be noted that this seal between the threads is due to the fact that the screws rotate in the same direction and that, consequently, the zones in which material accumulates are, in the case of one screw, above the plane of the axes, and, in the case of the other screw, below this plane. In contrast, when the screws rotate in opposite directions, the zone in which material accumulates is, in the case of both screws, either above or below the plane and the seal between the threads is less complete.

If a reagent is used, it is necessary to allow time for impregnation with this reagent and, consequently, to extend the treatment zone.

However, it is possible to carry out in the machine not only a pre-treatment of the material by steam-heating but also a true cooking process. Thus, it is possible to produce semi-chemical pulps by using reagents such as a neutral sulphite, cold soda or ammonium bisulphite. As already indicated, external control of the cooking temperature makes it possible to maintain the most desirable temperature for obtaining a rapid reaction.

Finally, since the intensity of the mechanical treatment can be controlled, as has been seen, it is possible to obtain pulps which are analogous to chemical pulps by further extending the length of the treatment zone, in order to achieve complete impregnation and the dissolution of the lignin by the chosen reagent.

In most cases, the reagent is associated with steam in order to steam-heat the material beforehand, upstream from the treatment zone.

The various parameters of the apparatus, and especially the lengths of the zones, are determined as a function of the process selected and of the impregnation time which may be allowed.

In order to limit the mechanical treatment and the risk of damaging the fibres, the length of the zones of reverse pitch is reduced to a minimum to produce the rise in pressure upstream. For example, in order to obtain impermeable plugs withstanding a steam pressure of less than 50 bars, the zones of reverse pitch can have a length of between one and three times the pitch, the latter being selected so as to obtain an adequate braking, taking into account the speed of advance of the material in the treatment zones and the width of the apertures 24; the latter have a width which, as has been seen, is sufficient to limit the retention of the material upstream, so as to effect at most only a simple separation of the chips, assisting the squeezing of the chips in the threads but without damaging the fibres. In general, the width of the apertures is between one third and one half of the mean length of the chips which, as is known, is about 30 mm.

Thus, by judiciously selecting the pitch of the threads, the length of the braking zones and the speed of rotation of the screws, it is possible to increase the pressure of the material up to about 30 to 40 bars.

Furthermore, the dimensions of the apparatus are obviously calculated as a function of the desired throughput. Thus, for a screw diameter of, for example, 100 to 120 mm, it is possible, in the cold soda process, to treat 200 kg of dry wood by introducing 40 kg of soda and 300 kg of water. In the conventional process, almost 800 kg of water would have been required. This increase in the concentration of the soda makes it possible to obtain a much more rapid treatment, since satisfactory dissolution of the lignin is achieved in a few minutes with a machine having a length of the order of 2 m, the length of the treatment zone then being, for example, 1,500 m whereas, in the conventional process, the cooking is carried out, as is known, in 2 to 3 hours in much more bulky installations.

Finally, since compression of the material causes the expulsion of the liquids, as already stated, the parameters of the apparatus are also selected so as to obtain the desired moisture content. In all cases, the latter must be sufficient (for example from 50 to 65%) to allow the material to advance satisfactorily. However, depending on the characteristics of the second braking zone, it is possible to obtain a more or less dry material at the outlet of the apparatus; for example, in certain cases, it is possible to produce a pulp containing from 60 to 70% of liquid.

As already stated, this regulation of the moisture content of the material influences the treatment and advancing process in the apparatus. The parameters of the latter must therefore be selected so as to obtain, on the one hand, satisfactory conditions of advance and, on the other hand, a final product which has the desired characteristics.

This regulation, which depends on numerous conditions, and especially on the characteristics of the wood, will be achieved to a certain extent in an empirical manner. These experiments are facilitated by the particular constructional arrangements of the apparatus and, in particular, the modular construction of the screws as sections assembled on a channelled or grooved core, which makes it possible to vary the relative length and the pitches of the various zones and also the width of the apertures in the screws in the zones of reverse pitch.

Furthermore, the use of an openable sheath, such as that described above, provides the significant advantage that the operation of the apparatus can be checked and that, with full knowledge of the situation, the various characteristics of the apparatus and of the process can thus be selected.

The invention is obviously not limited to the details of the embodiment which has now been described and which, on the contrary, can form the subject of numerous variants, since the apparatus which has been described can be adapted to most of the known processes for carrying out either a simple pre-treatment of the chips, or a true cooking process.

Moreover, if desired, it is possible to use several treatment zones, separated by continuous plugs produced by zones of reverse pitch. Each of these zones could be at a pressure and temperature selected as a function of the reagent. This will be the case particularly if, when carrying out a steam treatment before the chemical treatment, it is considered that the seal obtained between the successive threads is not adequate.

What is claimed is:

1. A process for the continuous impregnation of a cellulosic material in the form of chips, comprising passing said material continuously through apparatus comprising two parallel meshing screws having identical threads and which are rotated in the same direction inside a sheath which envelops them, said threads of said screws possessing successive zones of different pitch, wherein said material is passed continuously and in succession through a first zone of said screws for feeding and carrying said material downstream, a first braking zone of reverse pitch to the feeding and carrying zone which causes a first compression of said material, at least one subsequent zone for carrying said material downstream, in which, said material is brought into contact with a reagent introduced into said sheath, and a second braking zone of reverse pitch to the feeding and carrying zone which causes a second compression of said material, the braking zones possessing threads provided with apertures for the passage of the material downstream, during each said compression, said material passing through a series of alternate stages of increases in pressure, the relative magnitude of which increases gradually, and of drops in pressure, the relative magnitude of which decreases gradually, and the passage of said material through each braking zone causing a simple separation of said chips, which can assist the squeezing of the chips into said threads without decreasing the length of the fibers, said first compression causing the expulsion, in the upstream direction, of water present in said material, and each subsequent compression causing the expulsion of any spent reagent and of residual liquors present in said material, the overall impregnation treatment causing at least a partial delignification of said material to eliminate substantially completely the effect of shear on the chips.

2. A process according to claim 1, wherein said material introduced into said machine contains 50 to 55% of liquid, and a pulp containing from 20 to 30% of solids is obtained at the outlet of said machine.

3. A process according to claim 1 or claim 2, comprising selecting the pitches of said threads and the speed of rotation of said screws so that the pressure of said material is raised to 30 to 40 bars.

4. A process according to claim 1, wherein characteristics of the machine are selected so that the respective times of passage through said alternate stages of increase and drops in pressure are in keeping with the relaxation time of said material.

* * * * *